United States Patent [19]

Sakane et al.

[11] Patent Number: 4,707,387

[45] Date of Patent: Nov. 17, 1987

[54] COMPOSITE RUBBER MATERIAL AND PROCESS FOR MAKING SAME

[75] Inventors: Isamu Sakane, Ohtsu; Satsuki Kawauchi, Shiga, both of Japan

[73] Assignee: I.S.T. Corporation, Shiga, Japan

[21] Appl. No.: 940,163

[22] Filed: Dec. 9, 1986

Related U.S. Application Data

[62] Division of Ser. No. 788,432, Oct. 17, 1985, abandoned.

[51] Int. Cl.[4] ..... B05D 3/02

[52] U.S. Cl. ..... 427/393.5; 428/421; 428/422; 428/492

[58] Field of Search ..... 428/421, 422, 492; 427/393.5

[56] References Cited

U.S. PATENT DOCUMENTS 4,522,866 4/1987 Nishikawa et al. ..... 428/421

*Primary Examiner*—John E. Kittle
*Assistant Examiner*—P. R. Schwartz
*Attorney, Agent, or Firm*—Wenderoth, Lind & Ponack

[57] ABSTRACT

An improved composite rubber material having a baked layer of fluorine resin of 10 microns to about 1 millimeter in thickness is proposed. The coated layer of fluorine resin is baked at a temperature over 400° C. for not more than 7 minutes. This assures that the fluorine resin is baked without deteriorating the rubber material.

4 Claims, 1 Drawing Figure

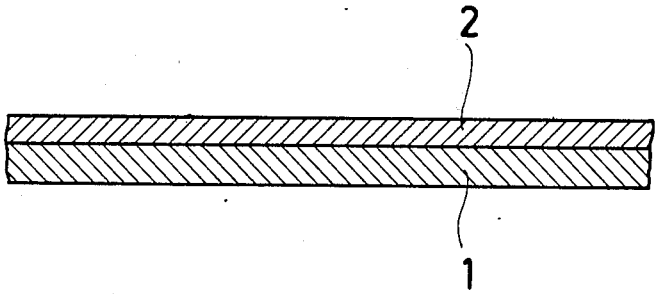
2
1

COMPOSITE RUBBER MATERIAL AND PROCESS FOR MAKING SAME

This application is a division of now abandoned application Ser. No. 788,432, filed Oct. 17, 1985, now abandoned.

The present invention relates to a composite rubber material made by coating a rubber material with a fluorine resin and baking the resin, and to a process for manufacturing the same.

As is well known, fluorine resins such as tetrafluoroethylene resin (hereinafter referred to as "PTFE"), tetrafluoroethylene perfluorovinylether copolymer (hereinafter referred to as "PFA") and tetrafluoroethylene-hexafluoropropylene copolymer (hereinafter referred to as FEP) are excellent in resistance to chemicals, heat resistance, electrical insulation, self-lubrication and non-adhesiveness, and are finding wide applications in various industrial fields. But, because of these properties, such fluorine resins are difficults to process. PTFE and PFA have a melting point at 327° C. and 306° C., respectively. They show the abovementioned excellent properties only after heated to over such temperatures.

It has already been proposed to form a layer of PTFE or PFA on a rubber material to give non-adhesiveness, resistance to chemical, resistance to solvent and resistance to oil which the rubber material does not have. However, this attempt has not been successful because the rubber material would decompose and deteriorate when the resin layer was heated for baking. This is true even if a relatively high heat-resistant rubber such as silicon rubber and fluorine rubber are used.

Another attempt tried was to firstly make a sheet, tube or sleeve of PTFE or PFA, and then apply a rubber material to the resin sheet or cause the rubber material to flow into the resin tube or sleeve. A still another attempt was to make a heat-shrinkable tube of PFA or PTFE, put it on a rubber material in the form of sheet, roll or rod and apply heat to cause the tube to shrink. With these methods it was difficult to form a thin layer of PTFE or PFA to reduce the cost. Also, if the layer is not thin, the elasticity, which is one inherent feature of rubber material, will be impaired. Further, because PTFE and PFA have non-adhesiveness, they will not adhere to the surface of rubber easily. This makes it necessary to adopt a very complicated process in which the surface of PTFE is etched with an alkali metal and an adhesive is physically anchored to its surface before adhering the resin layer to the rubber material. Another process is to make PTFE porous and bond the porous body to the rubber material.

An object of the present invention is to form on a rubber material a very thin baked layer of fluorine resin having good non-adhesiveness, corrosion resistance and resistance to solvent, without impairing the elasticity of the rubber material.

Other objects and features of the present invention will become apparent from the following description taken with reference to the accompanying drawing which is an enlarged sectional view of the composite rubber material of the present invention.

In accordance with the present invention, after a rubber material 1 has been coated with fluorine resin, the resin layer 2 is baked at a temperature over 400° C. for not more than 7 minutes. In more detail, after a rubber material has been coated with PTFE, PFA or FEP not baked yet by laminating, painting, etc., the coated rubber material is baked at a temperature higher than the melting point of PTFE, PFA and FEP, that is, over 400° C. for not more than 7 minutes.

For the baking of PTFE, it has been customary to bake at a temperature of 360°-380° C. for eight minutes or longer. It is disclosed in a publication that in making a composite material with fluorine resin, the base material is limited to one which can withstand the baking temperature (400° C.) such as iron, stainless steel, aluminium, and glass ("POLYFLON Handbook" published by Daikin, on page 73).

In accordance with the present invention, in order to bake only the layer of PTFE, PFA or FEP without applying heat to the rubber substrate, the coated rubber material is passed through a baking zone at a temperature of 400° C. or over, actually over 500° C. (which is very high, judging from common sense) for not more than 7 minutes. It is presumed that the fluorine resin is melted and baked by application of radiant heat as high as 500° C., contrary to the conventional idea that for baking it, it has to be heated for a relatively long period of time at a temperature within a narrow temperature range in which fluorine resins melt.

With the process according to the present invention, silicon rubber and fluorine rubber can be used as the rubber material. If selection of the baking temperature is appropriate, butyl rubber, ethylene vinyl acetate copolymer and acryl rubber, too, may be used. The rubber material used may be in the form of roll, sheet, tube, O-ring, rod or other shapes. Also, the rubber material used may be a composite material containing fabric material, metal, aromatic polyamide, or other material. The rubber material used may be one vulcanized or one not vulcanized yet. The rubber material used may be surface treated by mechanical grinding, liquid honing or chemical treatment. It may be one not surface treated.

The coating of fluorine resin on the rubber material may be done by dipping the material in the resin in the form of an aquous dispersion or an enamel, or painting the resin in a liquid or powdery state. A sheet, tube or rod of fluorine resin made by molding, extruding or rolling a fluorine resin composition containing a liquid lubricant may be adhered to the rubber material by pressing before or after removing the liquid lubricant.

The thickness of the coated layer of fluorine resin may be freely selected within the range from about 10 microns to about 1 millimeter.

The composite rubber material embodying the present invention is available in the form of a sheet, roll, tube or rod or any other shape.

The composite rubber material embodying the present invention may be used to make O-rings, rubber rolls, rubber sheets, rubber belts, rubber cables, or the like requiring chemical resistance, corrosion resistance, non-adhesiveness and elasticity. If fluorine rubber or silicon rubber is used as the substrate, the composite rubber material may be used to make such products for use at high temperatures within the range in which these kinds of rubber can withstand.

EXAMPLE 1

By applying silicon rubber to a metal shaft, a vulcanized rubber roller having a diameter of 80 mm and a length of 600 mm was made. After its surface has been ground with sand paper #320, an aqueous solution of tetrafluoroethylene resin (AD-1 made by Asahi Glass Co., Ltd.) was applied to the surface of the rubber roller to a thickness of about 18 microns. The roller thus coated was dried for about 5 minutes in a furnace at 200° C. It was then passed through a tunnel furnace at 650° C., 100 mm dia. 2 meters long, taking about 4 minutes, while turning it slowly.

The fluorine resin layer had been white before passed through the furnace. It became fully transparent after passing through it. Thus a composite roller having a silicon rubber roll coated with tetrafluoroethylene resin was obtained. The Shore hardness of silicon rubber was 50. This value was the same as that of silicon rubber before treated. No change in hardness or no deterioration was observed after treatment.

EXAMPLE 2

100 parts of fine powder of PTFE (POLYFRON F103 made by Daikin Kogyo Co., Ltd.) was mixed with 23 parts of naphtha. The mixture was extruded and rolled by a pair of calender rolls to a thickness of 120 microns and dried. The sheet of fluorine resin thus obtained was put on one side of a unvulcanized fluorine rubber sheet 3 mm thick, 150 mm wide and 200 mm long, and set in a hot press heated to 310° C. The assembly was kept in this state for one hour under a pressure of about 3 kg/cm$^2$ to vulcanize the fluorine rubber.

A composite rubber plate having a sheet of PTFE applied to its one side was thus obtained. However, the PTFE sheet was still in a unbaked state. The rubber plate thus made was passed under a hot plate at 530° C., 50 cm long, taking four minutes. An elastic rubber sheet having a fully baked PTFE sheet applied to one side thereof was thus made.

EXAMPLE 3

Powder of PFA (made by Du Pont) was painted by the powder painting process on an acryl rubber cord (10 mm dia.) to a thickness of about 20 microns. After dried at 120° C. for about 15 minutes, the coated cord was passed through a furnace one meter long and adjusted to 900° C. and a speed of 20 meters per minute. As a result, the PFA layer became opaque.

The composite rubber cord thus made had a tensile strength of 156 kg/cm$^2$ and an elongation of 140%. These values were the same as those of the rubber cord not treated with fluorine resin.

What we claim:

1. A process for manufacturing a composite material comprising a rubber substrate bearing a layer of fluorine resin of 10 microns to about 1 millimeter in thickness, said process comprising the steps of coating said rubber substrate with said fluorine resin and baking said fluorine resin at a temperature over the melting point of said fluorine resin, and wherein said fluorine resin is baked at a temperature over 400° C. for not more than 7 minutes, so as to not substantially deteriorate said rubber substrate.

2. The process as claimed in claim 1, wherein said rubber substrate is selected from the group consisting of silicon rubber, fluorine rubber, ethylene vinyl acetate copolymer, butyl rubber and acryl rubber.

3. The process as claimed in claim 1, wherein said fluorine resin is selected from the group consisting of tetrafluoroethylene resin, tetrafluoroethylene-perfluorovinylether copolymer, and tetrafluoroethylene-hexafluoropropylene copolymer.

4. The process according to claim 1, wherein the fluorine resin is tetrafluoroethylene perfluorovinylether copolymer in a thickness of 10 to 20 microns.

* * * * *